United States Patent [19]

Marin et al.

[11] Patent Number: 4,803,309

[45] Date of Patent: Feb. 7, 1989

[54] ELECTRICAL CABLE WITH OPEN HELIX SCREEN WIRES ELECTRICALLY CONTACTING A LONGITUDINAL WIRE AND MANUFACTURE THEREOF

[75] Inventors: Carlo Marin, Pavia; Cesare Seveso, Milan, both of Italy

[73] Assignee: Societaá Cavi Pirelli S.p.A., Milan, Italy

[21] Appl. No.: 18,592

[22] Filed: Feb. 25, 1987

[30] Foreign Application Priority Data

Feb. 28, 1986 [IT] Italy ..... 19598 A/86

[51] Int. Cl.[4] ..... H01B 7/22

[52] U.S. Cl. ..... 174/106 R; 156/50; 156/51; 156/56; 174/106 SC; 174/107; 174/108; 174/115

[58] Field of Search ..... 174/106 R, 107, 108, 174/115, 106 SC; 156/50, 51, 56

[56] References Cited

U.S. PATENT DOCUMENTS

| | | | |
|---|---|---|---|
| 1,852,127 | 4/1932 | Palmer | 174/115 |
| 2,133,863 | 10/1938 | Knoderer | 174/106 R |
| 2,258,687 | 10/1941 | Peterson | 174/115 |
| 3,324,233 | 6/1967 | Bryant | 174/115 |
| 3,927,247 | 12/1975 | Timmons | 174/115 X |
| 4,268,714 | 5/1981 | Mori | 174/115 X |
| 4,360,704 | 11/1982 | Madry | 174/107 X |
| 4,552,432 | 11/1985 | Anderson et al. | 174/106 R X |
| 4,626,619 | 12/1986 | Uematsu | 174/106 R X |

FOREIGN PATENT DOCUMENTS

| | | | |
|---|---|---|---|
| 33514 | 1/1981 | European Pat. Off. | 174/115 |
| 1918121 | 10/1970 | Fed. Rep. of Germany | 174/108 |
| 3243915 | 5/1984 | Fed. Rep. of Germany | 156/50 |
| 1159428 | 7/1969 | United Kingdom | 174/106 |

*Primary Examiner*—Morris H. Nimmo

*Attorney, Agent, or Firm*—Brooks Haidt Haffner & Delahunty

[57] ABSTRACT

An electrical cable with a core comprising an electrical conductor surrounded by insulation and with both a screen of wires in open helix configuration on the core and at least one other wire extending longitudinally of the core and electrically contacting the wires of the screen. An insulating sheath surrounds the screen and may itself embed the wires or it may surround a layer of extruded material which at least partially embeds the wires. The material of the layer may be insulating or semi-conductive. Also, a process for manufacturing such cable.

11 Claims, 3 Drawing Sheets

ELECTRICAL CABLE WITH OPEN HELIX SCREEN WIRES ELECTRICALLY CONTACTING A LONGITUDINAL WIRE AND MANUFACTURE THEREOF

The present invention relates to an electric cable of the type provided with an extruded insulation and having an improved outer screen made of metallic wires, as well as to the process for applying the said screen to the cable.

Electric cables with extruded insulation generally comprise a core formed by an electrical conductor, a first semi-conductive layer, an extruded insulation of plastomeric or elastomeric material, and a second semi-conductive layer. On this core, there is applied a concentric metallic screen which provides a path of low electrical resistance for assuring the intervention of protective devices as soon as any condition of damage in the cable, which renders it necessary, is verified.

The core can also have a structure which is different from the one described and can be formed, for example, by several conductors insulated from each other, and with a single semi-conductive outer layer. Alternatively, one or both of the semi-conductive layers can be omitted. Hereinafter, the term "core" will mean that part of the cable underlying the electrical screen which is made of wires and/or tapes of conductive material and which is generally connected to ground. Hence, said core comprises at least one electrical conductor and one extruded insulation.

The metallic screen is generally realized with good conductivity metallic wires (for example, copper) wound around the cable core.

According to a known technique, the metallic wires are wound helicoidally around the cable core by means of rotating bobbins which are disposed along the production line, and the electrical continuity of the screen is assured by copper tapes. The cable core is then collected onto bobbins and transferred to an extrusion line, for the purpose of the application of the protective sheaths and of other extruded layers.

This process requires machinery which has a rotating cage which, besides being complex and costly, also requires halting of the production line whenever the bobbins containing wires and/or copper tapes, are about to run out.

A later improvement for these type of cables was had with cables where the wires are wound around the core according to a helix which is periodically reversed in hand, known as an open helix, or S-Z helix.

Nevertheless, although the bobbins of wires are fixed in this later method and only the portions of wires which are close to the cable are subjected to an alternating rotation, the cable has to be immediately wound with tapes for holding the screen wires in proper positions.

Hence, to apply the metal tape for realizing the electrical continuity between the screen wires, a rotating binding head is required. Therefore, even when manufacturing this type of cable, there are also present rotating devices for binding with metallic tapes, and consequently, it becomes necessary to halt the production line for substituting a new bobbin of tape for the bobbin tape which has run out.

Moreover, with this process it is difficult to guarantee an even and constant spacing between the wires as required by the safety standards for this type of screen.

In fact, in particular, the wires tend to become closer spaced, in correspondence to the helix reversals, during the construction of the screen, and other local wire shiftings can take place as a result of bends in the cable during the collecting and laying operations.

A further limitation of the cables having a screen thus obtained consists in the lack of longitudinal watertight sealing against the eventual infiltration of water into the sheath, since the assembly of wires and of metallic tapes offers an easy way for the water to spread. If a watertight sealing is required, it is necesssary to provide a further binding with fabric tapes, incorporating swelling powders, or else, the introduction of these powders prior to extruding the sheath.

One object of the present invention is to provide an electric cable having an extruded insulation and in which the positioning of the metallic screen wires does not require any binding with tapes, in such a way as to simplify cable production and, in particular, to render the production to be continuous and uninterrupted.

A further object of the invention is to provide a cable whereby the space between the screen wires is kept rigidly constant both, during cable manufacturing, as well as during cable functioning.

Another object of the invention is to provide a cable in which the screen is able to prevent the longitudinal spreading of the water which eventually penetrates into the sheath.

In accordance with the invention, an electrical cable, comprising a cylindrical core formed by at least one electrical conductor and by an extruded insulation, with a screen upon said core formed by metallic wires wound according to an open helix, is characterized by the fact that said screen comprises at least one further metallic connecting wire which extends longitudinally along the core and which is in electrical contact with the wires of said screen, and by the fact that all the metallic wires are embedded and kept in position by a layer of material which is extruded around said core.

In addition, the invention relates to a process for applying a screen of metallic wires wound, in an open helix configuration, around the core of a cable, characterized by the fact of comprising the steps of:

(1) causing the said core to advance;

(2) disposing on the core a plurality of parallel metallic wires according to an open helix configuration and at least another metallic wire disposed longitudinally along the core; and (3) extruding, in correspondence to the point where the wires contact the core, a layer of material, in such a way as to embed said metallic wires, and to keep them permanently in position.

The layer of extruded material can consist of an elastomeric, or a plastomeric compound having a thickness less than the diameter of the screen wires, for just partially embedding them or having a thickness greater than that of the diameter of the wires. In case the wires are completely embedded, the extruded layer can be the plastic material of the sheath which is applied over the metallic screen.

Other objects and advantages of the present invention will be apparent from the following detailed description of the presently preferred embodiments thereof, which description should be considered in conjunction with the accompanying drawings in which.

Figure 1:
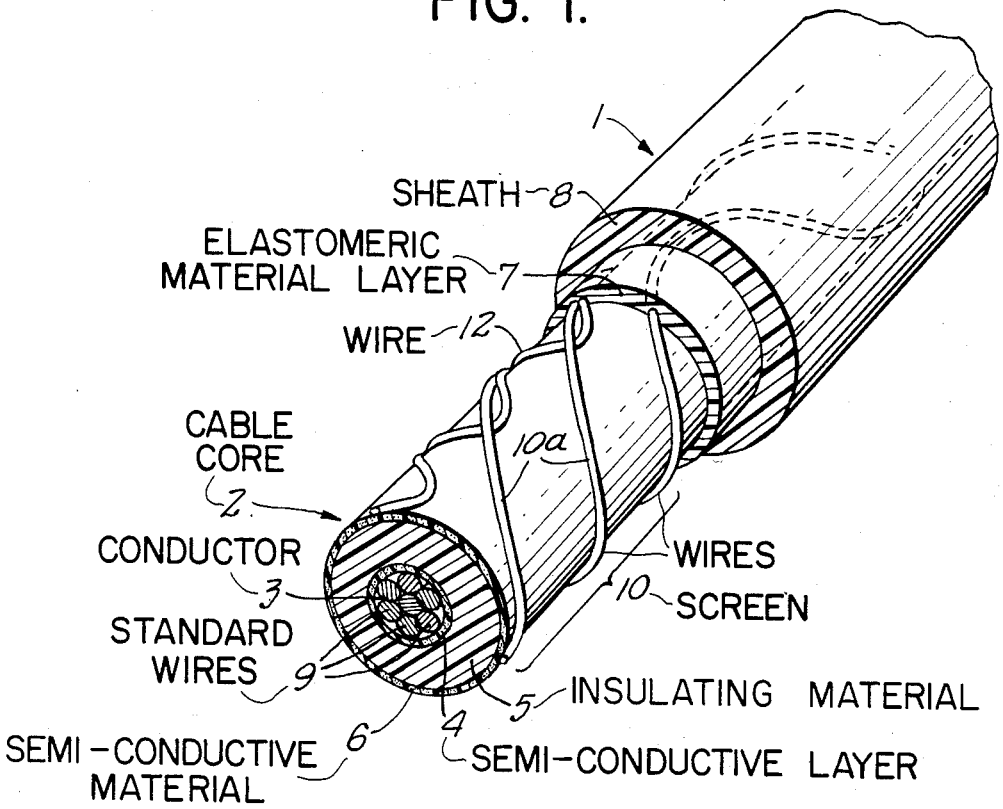
FIG. 1 is a perspective view, partly in cross-section, of the invention with portions of some parts removed.

The cable 1, shown in FIG. 1, is a unipolar medium voltage cable, and it comprises a core 2 formed by a single central conductor 3 of stranded wires 9, for example, aluminum wires around which is extruded a layer 4 of semi-conductive material, a layer 5 of insulating material and a layer 6 of semi-conductive material.

Outside the core 2, there is a screen 10 which comprises a plurality of metallic wires 10*a*, wound in open helix configuration (which is partially shown with broken lines), at least one metallic wire 12 that extends longitudinally along the core, and a layer 7 of elastomeric material which embeds all said metallic wires in such a way as to keep them in position and to protect them from any eventual corrosion phenomena. A protective sheath 8 made of polyvinylchloride, polythene, or another plastic material covers the layer 7 embedding the metallic screen.

The layer of elastomeric material 7, is formed by a compound, preferably an insulating compound, and a thickness sufficient to keep all the screen wires in their respective positions.

Figure 4:
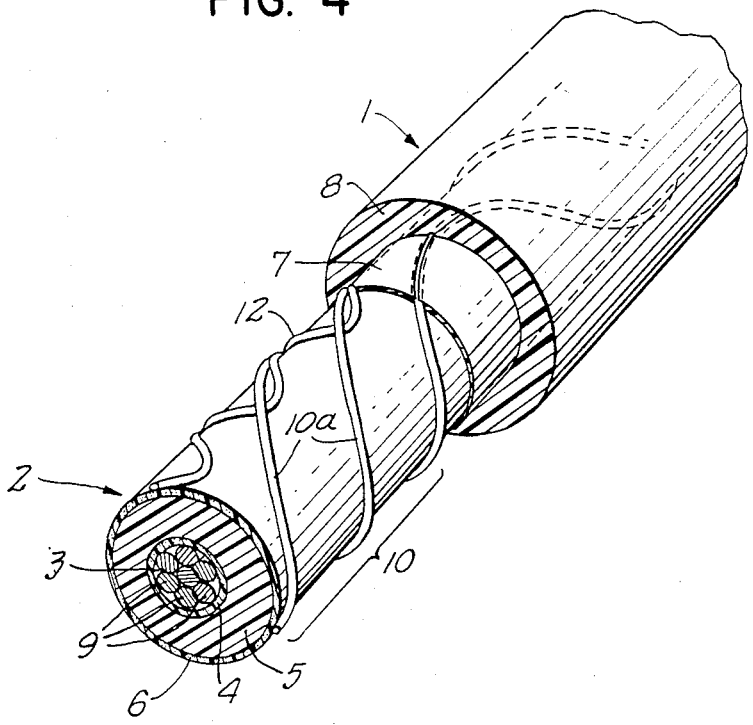
FIGS. 4 and 5 are similar to FIG. 1 and illustrate alternative embodiments of a cable according to the invention.

Preferably, the thickness of the layer 7 is the minimum which will prevent any movements of the wires, and the thickness of said layer can be less than the diameter of the wires themselves, i.e. with only partial embedment of them as shown in FIG. 4.

The layer 7 of elastomeric material can be semi-conductive in case, for example, further assurance is desired for the electrical connection between the metallic screen 10 and the underlying semi-conductive screen 6.

The metallic wire 12 carries out the function of electrically connecting together the wires which form the screen 10. Preferably, and as shown in the drawings, said wire 12 follows an undulated course with respect to a generatrix of the core 2 so that the length of the wire 12 is longer than the core 2. This allows for bending of the cable without causing any dangerous stresses on the connecting wire 12.

Figure 5:
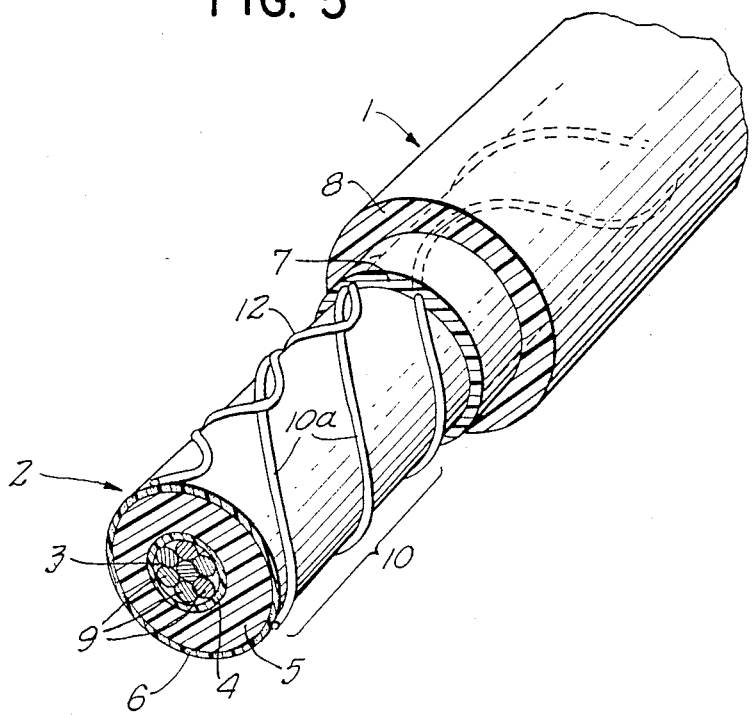

Preferably, the connecting wire 12 is disposed radially inwardly of the wires 10*a* although it can be positioned outside the wires 10*a* as shown in FIG. 5.

The material forming the extruded layer 7 is part of the so-called class of thermoplastic fillers (or non-vulcanized fillers) based on loaded elastomers. It is formed, preferably, of a composition based on ethylene-propylene rubber, loaded with calcium carbonate, with or without the addition of plasticizers and/or lubricants, depending on the particular machinery used for the processing. Other compounds can also be used, for example, compounds based on natural rubber, styrol rubber, butyl rubber, etc.—loaded with other loading minerals, for example, kaolin, with or without the addition of plasticizers and/or lubricants.

Preferably, the compound is soft enough at room temperature to allow any slight settling movements of all the wires as a whole, i.e., while keeping their respective spacings, when the cable is wound and unwound.

Figure 2:
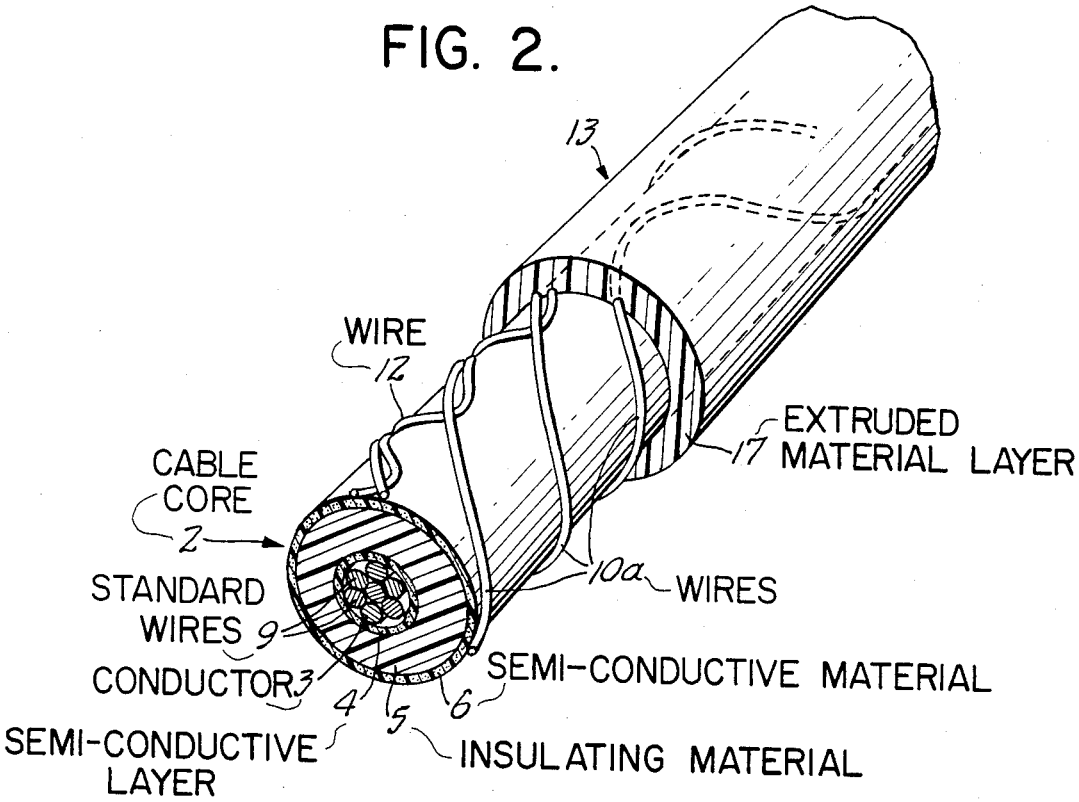
FIG. 2 is similar to FIG. 1 and illustrates an alternative embodiment of a cable according to the invention.

In the cable 13 shown in FIG. 2, the core and the screen have substantially the same structure as the cable shown in FIG. 1, and the same reference numerals have been used for indicating analogous parts. However, instead of separate layers 7 and 8, a single layer of extruded material 17 which completely embeds the wires also forms the plastic sheath of the cable 13. These embodiments offer the advantage of eliminating an extrusion operation during construction of the cable.

Figure 3:
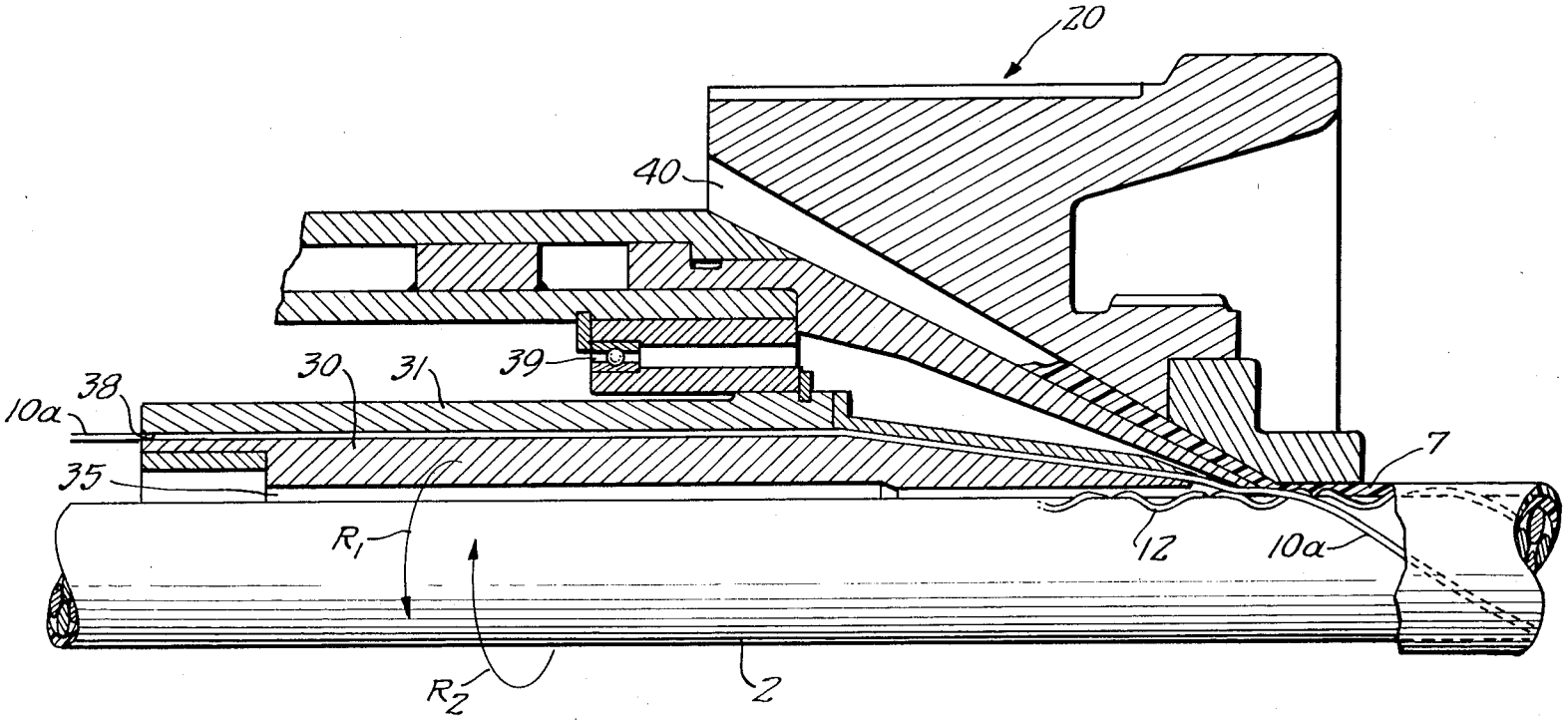
FIG. 3 is a partial longitudinal section of an extrusion head for carrying out the process according to the invention.

FIG. 3 illustrates an extrusion head by which the process according to the invention can be put into practice.

The cable core 2, after having passed through the accumulator pipe (not shown), on which the metallic wires for the screen are wound and unwound, enters inside a guide 30 for the screen wires 10*a*. The guide 30 is formed by a cylindrical body tapered at one extremity and provided with peripherally spaced, longitudinal grooves 38 inside which the metallic screen wires 10*a* are lodged and guided. A similarly tapered cylindrical sleeve 31 is disposed around the guide 30 in such a way as to allow the wires 10*a* to enter into closed canals without any risk of their coming out.

The guide 30 and the sleeve 31 are mounted on the extrusion head 20 by bearings, such as those indicated by the numeral 39 in FIG. 3, and they are caused to move with an alternating rotary motion with respect to the extrusion head, as indicated by the arrows R1, R2, by means known in the art, such as a belt pulley transmission system (not shown for the sake of simplicity).

The inner diameter of the cylindrical body 30, is greater than the diameter of the core 2, advancing inside it, so as to leave a clearance 35 along which the previously undulated and applied connecting wire 12 passes.

Moreover, in the extrusion head 20, there is an extruding canal 40 which receives the material which forms the layer 7 (or alternatively, the sheath 17) embedding the screen wires 10*a*.

Said canal 40 opens on the core 2 in a position immediately adjacent to the openings of the grooves 38 through which the screen wires 10*a* pass. Since the wires 10*a* are subjected to the alternating rotary motion of the guide 30, they are laid on the core 2 (over the connecting wire 12) according to an open helix configuration. The thus formed screen of metallic wires 10*a* is immediately embedded by the elastomeric or plastomeric material extruded through the canal 40 in such a way that the wires are fixed in their desired positions in a permanent manner, through the solidification of the plastomeric material.

Although in the preferred embodiment of the invention, the connecting wire 12 follows an undulating path, the connecting wire 12 can follow a rectilinear path. Also, the core 2 can comprise insulated conductors different from those shown, other elements, etc.

Although preferred embodiments of the present invention have been described and illustrated, it will be apparent to those skilled in the art that various modifications may be made without departing from the principles of the invention.

The embodiments of the invention in which an exclusive property or privilege is claimed are defined as follows:

1. In an electrical cable comprising a cylindrical core which is formed by at least one electrical conductor with extruded insulation therearound and comprising a screen upon said core formed by a plurality of metal wires applied to said core along paths conforming to an open helix, the improvement comprising at least a further metal connecting wire which extends longitudinally along a path which is undulated with respect to a generatrix of said core, which extends in the direction of and parallel to a generatrix of said core, which extends transversely to said paths of said plurality of metal wires without encircling said core and which is in electrical contact with all the wires of said screen, and a layer of extruded material around said core and at least partially embedding said wires of said screen and said further metal connecting wire whereby said wires of said screen and said further connecting wire are held in their respective positions by said layer.

2. An electrical cable as set forth in claim 1 wherein said layer of extruded material has a radial thickness greater than the diameter of said wires of said screen.

3. An electrical cable as set forth in claim 2 wherein said layer of extruded material is an elastomeric insulating compound.

4. An electrical cable as set forth in claim 1 wherein said layer of extruded material has a radial thickness less than the diameter of the wires of said screen.

5. An electrical cable as set forth in claim 1 wherein said layer of extruded material is semi-conductive.

6. An electrical cable as set forth in claim 1 wherein said further metal connecting wire is between said wires of said screen and said core.

7. An electrical cable as set forth in claim 1 wherein said paths, and hence, said plurality of wires, are in laterally spaced relation to each other.

8. Process for applying a screen of metal wires in an open helix configuration around the core of a cable comprising:

while longitudinally advancing a core, depositing on the core a plurality of parallel metal wires while producing relative motion between said wires and the core in alternately different directions circumferentially of the core to cause said wires to follow paths conforming to an open helix configuration; and before so depositing said plurality of metal wires on the core and while so advancing the core, depositing at least one other metal wire on the core in electrical contact with all said plurality of metal wires, said one other metal wire being deposited along a path which is undulated with respect to a generatrix of the core, which extends longitudinally and in the direction of and parallel to the generatrix of the core and which extends transversely to the paths of said plurality of parallel metal wires without encircling said core; and at the point where said plurality of metal wires are deposited on the core, extruding a layer of material over said plurality of metal wires.

9. A process as set forth in claim 8 wherein said plurality of metal wires are deposited in laterally spaced relation.

10. Process for applying a screen of metal wires in an open helix configuration around the core of a cable comprising:

while longitudinally advancing a core, depositing on the core a plurality of parallel metal wires while producing relative motion between said wires and the core in alternately different directions circumferentially of the core to cause said wires to follow paths conforming to an open helix configuration; and after so depositing said plurality of metal wires on the core and while so advancing the core, depositing at least one other metal wire on the core in electrical contact with all said plurality of metal wires, said one other metal wire being deposited along a path which is undulated with respect to a generatrix of the core, which extends longitudinally and in the direction of and parallel to the generatrix of the core and which extends transversely to the paths of said plurality of parallel metal wires without encircling said core; and at the point where said at least one other metal wire contacts said plurality of metal wires, extruding a layer of material over said plurality of metal wires and said at least one other metal wire.

11. A process as set forth in claim 10 wherein said plurality of metal wires are deposited in laterally spaced relation.

* * * * *